US006158633A

United States Patent [19]

Schwab

[11] Patent Number: 6,158,633

[45] **Date of Patent: *Dec. 12, 2000**

[54] HANGING ELEMENT FOR CLOTHING

[75] Inventor: Wolfgang Schwab, Starzach, Germany

[73] Assignee: Schwab's GdbR, Design Care & Marketing, Starzach, Germany

[ * ] Notice: This patent issued on a continued prosecution application filed under 37 CFR 1.53(d), and is subject to the twenty year patent term provisions of 35 U.S.C. 154(a)(2).

[21] Appl. No.: 08/860,908

[22] PCT Filed: Nov. 6, 1996

[86] PCT No.: PCT/EP96/04834

§ 371 Date: Oct. 16, 1997

§ 102(e) Date: Oct. 16, 1997

[87] PCT Pub. No.: WO97/17875

PCT Pub. Date: May 22, 1997

[30] Foreign Application Priority Data

Nov. 14, 1995 [DE] Germany ..... 195 42 327

[51] Int. Cl.[7] ..... A47G 25/14

[52] U.S. Cl. ..... 223/85; 223/87

[58] Field of Search ..... 223/85, 87, DIG. 4, 223/92, 95

[56] References Cited

U.S. PATENT DOCUMENTS

| | | | |
|---|---|---|---|
| 1,375,808 | 4/1921 | Witbeck | 223/87 |
| 1,470,925 | 10/1923 | Klein et al. | 223/87 |
| 1,755,605 | 4/1930 | Krox | 223/85 |
| 2,522,013 | 9/1950 | Anderson | 223/93 |
| 3,085,725 | 4/1963 | Caparosa | 223/87 |
| 3,398,839 | 8/1968 | Ballenger et al. | 211/13 |
| 3,456,853 | 7/1969 | Hodge | 223/87 |
| 3,837,544 | 9/1974 | Greenwald | 223/87 |
| 3,984,002 | 10/1976 | Howard | 223/85 |
| 3,997,091 | 12/1976 | Burnette | 223/87 |
| 4,542,838 | 9/1985 | Perez-Tubens et al. | 223/87 |
| 4,685,572 | 8/1987 | Jamison | 223/85 |
| 4,768,649 | 9/1988 | Kolton et al. | 206/296 |
| 4,805,816 | 2/1989 | Freund | 223/66 |
| 5,038,978 | 8/1991 | Kolton et al. | 223/85 |
| 5,056,248 | 10/1991 | Blanchard | 223/85 |

FOREIGN PATENT DOCUMENTS

| | | |
|---|---|---|
| 8703404 | 9/1988 | France . |
| 8804471 U | 6/1988 | Germany . |

*Primary Examiner*—Bibhu Mohanty
*Attorney, Agent, or Firm*—Christie, Parker & Hale, LLP

[57] ABSTRACT

A hanging element is manufactured to be a deformed shock proof synthetic-substance sheet manufactured by a vacuum-forming process; is formed as an essentially flat element with areas (28, 29) to print information on it; contains horizontally placed strengthening elements (6, 15 to 18); and shows close to its upper edge (3) and in the center of its upper edge a gap (8) which is connected with the upper edge by a cut (7). The measurements have been designed in such a way that a rail (9) can be arranged in it and in which the width of the cut (7) is less than the width of the rail (8).

28 Claims, 2 Drawing Sheets

Fig. 5A
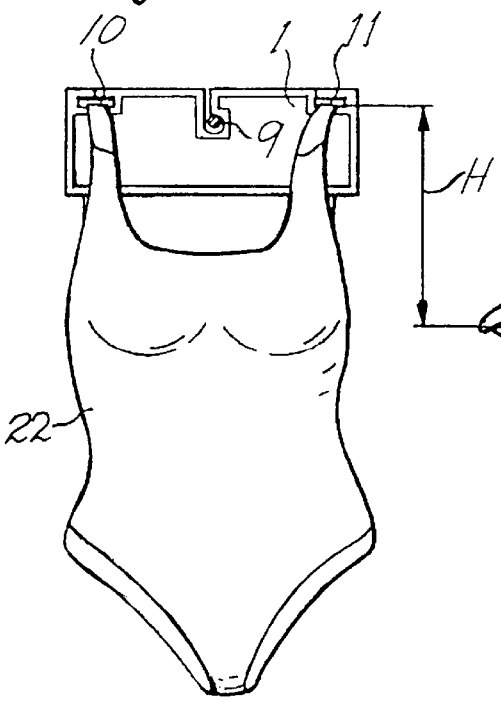
Fig. 5B
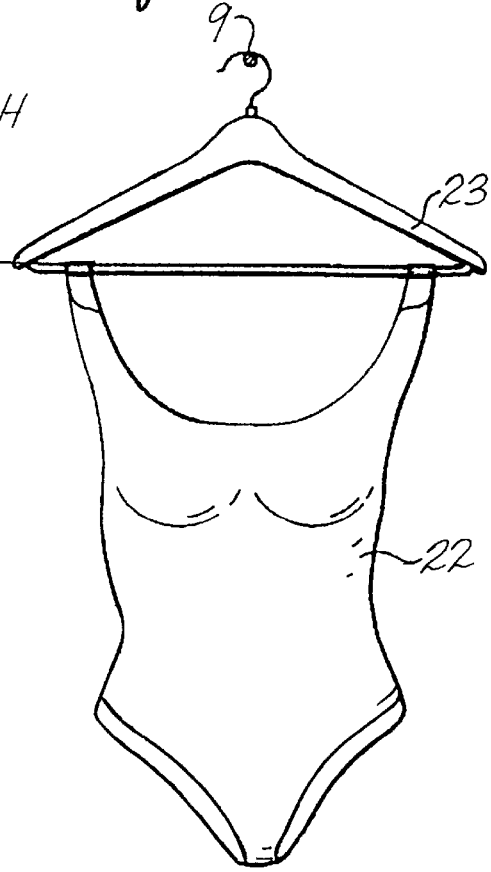
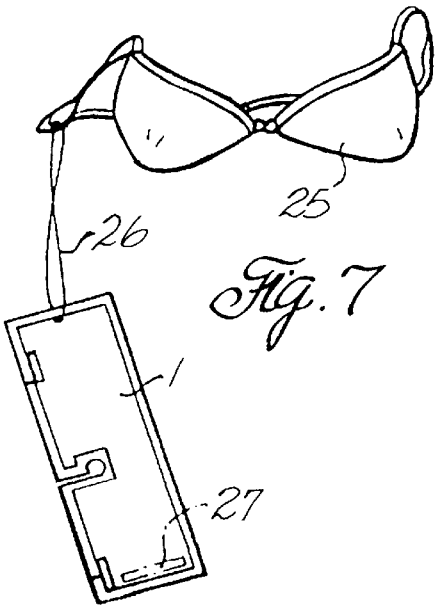
Fig. 7
Fig. 6
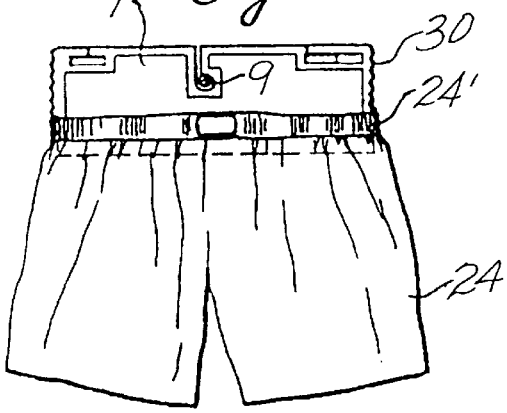

HANGING ELEMENT FOR CLOTHING

This invention relates to a hanging element for underwear.

Well known types of hanging elements are known as hangers. These have a relatively narrow elongate body and a hook portion which hooks over a clothes rail for example. Such hangers suffer from a disadvantage that a significant amount of space is required above presented underwear and that since that hangers are normally supported on garment rails a large hanging opening is required.

It is an object of the present invention to provide a hanging element which requires less space to present underwear or other textiles in a retail environment for example.

It is a further object of the present invention to provide an improved hanging element for underwear.

According to the present invention there is provided a hanging element characterised by a surface suitable for printing information upon; a through hole for receiving a garment rail, the through hole being connected to the upper edge of the element by a cut, the cut having a width less than that of the garment rail; and one or more horizontally disposed strengthening elements.

According to the present invention there is further provided a hanger for hanging and presentation of underwear or lightweight textiles, characterised in that the hanger a) is manufactured from a shock-proof sheet of a synthetic substance, b) is formed as a substantially flat element provided with areas to print information on, c) contains strengthening portions, and d) comprises, towards its upper edge and in the centre thereof, a through-hole connected to the upper edge by a cut, the hole being sized to receive a rail and the width of the cut being less than that of the rail.

The element may be of a shock proof material such as a plastics material, cardboard or other material. It is preferably formed as a plastics foil or sheet and is preferably thermoformed or may be formed by any other method of forming plastics articles, such as by injection moulding, lamination, blow moulding, stamping or other techniques.

The hanging element may be used both as a holder element and as label, incorporating product information, advertising slogans and/or other matter in a space saving design.

Since the hanging element essentially comprises a lamina, the hanging and diagonal bracing of goods which are to be supported by the hanging may be done without any further bracing means and using a very flat hanging means. The goods may be supported in prepared pressed holes (fastening holes) which are prepared in predetermined places optimal for the stability of the hanging, balance and for space saving presentation as well as improving the look and presentation of the article. The element thereby differs from more conventional type of hangers which are equipped with suitable fixing equipment for the goods, usually formed by width clips or large insertion noses. A problem with conventional hangers is that if they are designed to be able to be used with goods of various sizes, they do not perfectly fit any one size and goods have to be stretched to fit over them, resulting in an unnatural appearance. The construction of the present invention enables diagonal bracing of the goods, eg parts of underwear, by the self elasticity of the goods. The width of the hanging element can be adapted to the parts of the underwear, for example to the waist measurement. Thus, considerable advantages are obtained concerning the sectors of labels, securing of the goods, hanging of the goods and the inscription of information on the hanger. The hanging element of the present invention is appropriate for frequent use and simple handling.

Usually, customers take the hangers on which the underwear is presented in the shops home for their own use. The possibility of printing or otherwise affixing information to a hanger of the present invention is beneficial in this regards since it enables printed information relating to the item of clothing to be available to the customer at home.

Omission of the standard metal hook which is achieved by the provision of the through hole integrated into the sheet of the hanging element according to the present invention results in a large space saving which can be used to enlarge sales areas within shops considerably. Furthermore, handling itself is considerably improved. It has been found that a space saving of at least 25% up to multiples may be achieved. Furthermore, since the entire hanging element is made of a single material, eg of vacuum-formed plastics material, considerable advantages are obtained in terms of handling and products and also recycling of the hangers at the end of their life time is facilitated. The manufacturing costs are also much lower due to the considerably reduced requirement of material and time. Previously available hangers can contain up to four materials, including various metal elements, and are therefore much more difficult to recycle.

A hanging element according to the present invention may be labelled with recycling instructions which apply to the whole element. The elements also do not provide hazardous waste, contrary to the usual type of hangers, and therefore recycling costs are reduced, handling without disruption and suitable stacking in the filled as well as empty conditions are ensured.

A plastic lamina forming the hanging element is preferably formed by a vacuum-forming technique which enables an extremely long period of use and enables the plastics material to be shock proof to combine the necessary stability with the necessary elasticity in a way to reduce the danger of breakage or injury.

The ability to also use the hanging element as a label for the goods secured to it enables the element to be packaged in boxes with the product, as well as being used for its hanging. Thus, the same hanging element can be supplied to both the seller of so-called 'precious' goods who sells the goods in packed form and the seller who presents the goods in hanging form.

For purposes of security, the hanging element may be provided with security devices. In one of these, the hanging element may be physically connected to the goods by means of a thread, such as a nylon thread. This reduces the risk of theft. It is extremely difficult to break or to fold up the plastics sheet forming the hanging element and the thread can be affixed in such a manner that only if the sheet is destroyed is it possible to tear or remove the thread. When the hanging element is used as a label, it is not as easy to hide as a usual trade label. The hanging element can show a great deal of information and the surface of the hanging element can be printed not only with a company logo, trade mark, sizes and product information and so on but also with code information (eg bar codes, security codes) and other product information. Thus, the use of the additional labels which tended to be required before are not now applicable.

In a preferred embodiment, the hanging element is provided on one side (eg the front side) with product information and on the other side (eg the back side) with information such as security information and internal codes related to logistics, check-out information and so on. In further modifications, electronic security means may be integrated into the structure of the hanging element. Electronic circuitry, eg thin film electronic circuits may even be integrated into the structure.

Embodiments of the invention will now be described, by way of example only, with reference to the accompanying drawings, in which.

FIG. 5*a* shows a one-piece swimsuit in combination with a display element according to the present invention;

FIG. 5*b* shows a one-piece swimsuit in combination with a prior art hanger;

FIG. 6 shows a pair of swimming trunks in combination with a hanging element; and FIG. 7 shows a piece of underwear secured to a hanging element.

Figure 1:
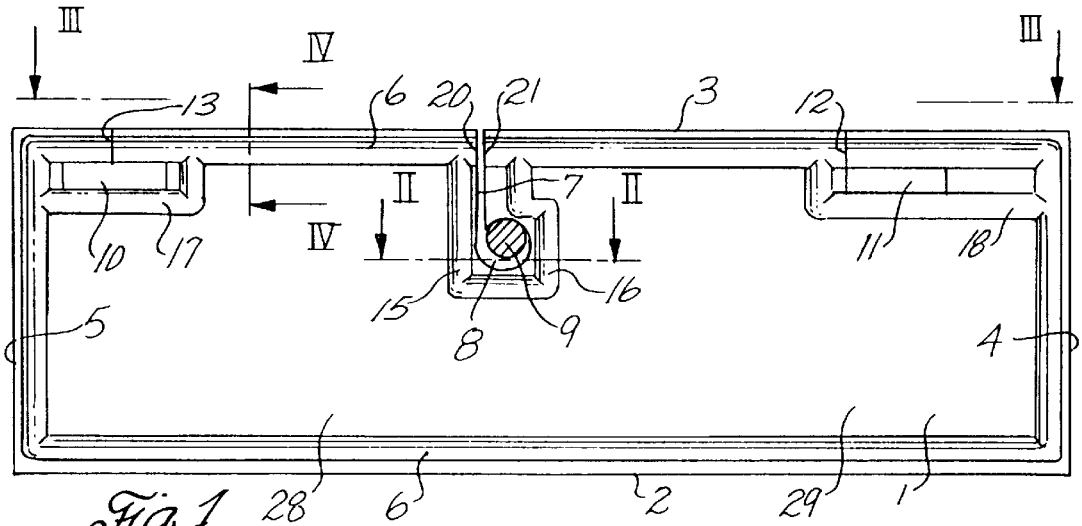
FIG. 1 shows a hanging element.
Figure 4:
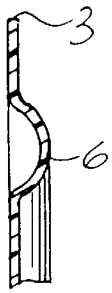
FIG. 4 shows a cross-sectional view along the IV—IV in FIG. 1.

FIG. 1 shows a hanging element having a rectangular form. The element has, for example, a length of 25 cm and a width of 8.5 cm. The hanging element may be formed from and generally forms a flat sheet or lamina. It consists of a vacuum-formed sheet, for example PVC, which is durably to be deformed during the vacuum-forming manufacturing. The sheet may alternatively be formed by any other plastics forming technique, such as injection moulding, blow moulding, thermo-forming, etc and may be of any suitable plastics material, cardboard or other materials. The sheet has, for example, a strength of 0.5 mm. Along the edges 2, 3, 4, 5 are formed, in cross-section, as shown in FIG. 4, circle segmental slots or bulges 6. These help to strengthen the edges against bending.

Roughly in the middle of the upper edge is a vertical cut 7. This cut leads to a round through-hole 8 with a diameter of about 11 mm. In use, hole 8 embraces a bar 9 (eg a garment rail) with a diameter of about 6 mm. Cut 7 is of less width (eg 2 to 3 mm less) than the diameter of the bar, and may indeed be formed merely by a cut, the edges of which abut one another unless physically pulled away from each other to allow a bar 9 to be pushed past them laterally into hole 8. Toward the upper edge 3 the hanging element has two slots 10, 11, which are accessible by the respective cuts 12, 13 from outside. These cuts may again be merely cuts or may have a thickness, for example of 0.5 mm. In principle, the diameter of hole 8 has to be bigger than the diameter of a bar 9 on which the hanger is to be supported so that enough room for movement eg for gliding on the bar is provided. The position and the width of the slots 10 and 11 can be chosen so that way that they suit exactly to the width of the straps of the goods which are to be hanged in them. On the other hand, their distance to the cut in the middle, that enables the hanging on a bar, should preferably be symmetrical, so that a precise balance is given. Cuts 12 and 13 are shown as extending from the upper edge. They may alternatively extend from the side edges or otherwise and are provided to enable clothing or straps to be moved into the slots.

Through-hole 8 is partially surrounded by strengthening bulges 15, 16. These are responsible for the stabilisation of the flat element which forms hanger 1, concerning the space around the cut, especially along cut 7. The slots 10,11 are also partially surrounded by bulges 17,18 which together with bulge 6 along the upper edge 3, make simple safe hanging of the goods possible.

The slots or bulges for strengthening and stiffening can be provided in many different ways. Especially, their form and their size can be adapted to the inscription area that is also intended for the hanging element. The stability of the element can be influenced by varying the thickness of the sheet 1. In order to ensure a uniform look also of various sizes of the hanging element, as far as that is possible, the raising of the strength which is necessary for wider formed hanging elements is possible by a hardly perceptible raising of the thickness of the foil.

Figure 3:
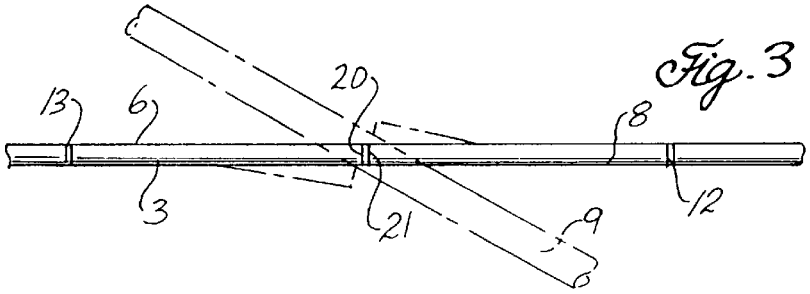
FIG. 3 shows a view from above in the direction of arrows III—III in FIG. 1.
Figure 2:
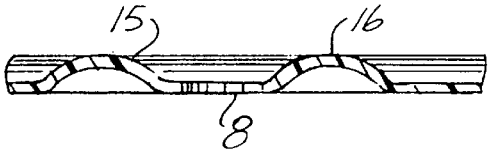
FIG. 2 shows a cross-section along the line II—II in FIG. 1.

Insertion of hanging rail 9 or, in other words the hanging of hanger 1 in a bar 9 is carried out in the manner shown in FIG. 3, in which both ends 20,21 which are separated from each other by cut 7, are bent apart in opposite directions essentially perpendicular to the plane of the hanger 1. The hanger is then presented to bar 9, in a tilted disposition as shown, and pushed upward to 'click' bar 9 into place within hole 8. The required movement of ends 20 and 21 is only possible if it is intended and a degree of effort (although slight) is used. It cannot happen by itself. If the hanger hangs on a bar 9, as shown in FIG. 1, it does not open by itself, even if a relatively heavy weight is hanged on it. A relatively tough-elastic sheet and its stiffening by the strengthening elements manufactured in a vacuum-forming or other process aids this. Of course, the strengthening can be produced also in other ways, eg by ribs or something similar, cross-section distortions or by the assembling of further strips or similar features that increase the bending moment. Unintentional falls of the hanger are no longer to be feared and tangling up of two hangers or of hanger and goods is virtually impossible.

FIG. 5*a* shows a typical example for the presentation of underwear. A one-piece swimsuit 22 is shown on a hanger 1. FIG. 5*b* shows a prior art hanger 23 with a swimsuit hung on it. From this comparison another very significant advantage can be seen: hanger 1 and hanger 23 are hanged at the same height on a bar 9. Nevertheless, the hanging of such a piece of underwear on a prior art hanger 23 needs more space in the vertical direction, as demonstrated by line H. Comparing the exemplary measurements described herein of hanger 1 and the measurements of a usual hanger the difference in height H can be about 15 cm, which is space which can be saved by the use of hanger 1 according to the present invention. In the direction perpendicular to the paper of the drawing a further saving of space is given by the fact that the usual hangers 23 are much thicker than the lamina or sheet of which hanger 1 is manufactured. Both of the strips of the swimsuit are hanged in cuts that are accessible from outside by the backwards and forwards bending of the slots that surround the cuts 10,11 in a similar way to that shown in FIG. 3 for cut 7. As a result of the elasticity the foil jumps back in its original position and keeps the hanged goods safely until they are required to be removed.

FIG. 6 shows the presentation of a pair of swimming trunks combined with a hanger 1. It is simple to draw in the elastic waist-band of the pair of swimming trunks on the hanger 1. This example shows how such a hanger as demonstrated is easily to standardise and therefore is adaptable to various sizes of underwear and clothes. Bending out of shape because of the tension of the elastic waist-band is avoided by the bulges or other strengthening elements. Slipping down of the diagonally braced goods may be counteracted by a wedged-formed or conical widening of the hanger towards its lower edge and/or by a wave notch 30 or by other means.

FIG. 7 shows the way in which a part of underwear, in the demonstration example a bra, may be connected with a hanger 1 by a strong nylon-splint thread 36. The nylon thread 26 is preferably the kind that is used generally for the fixing of price or security labels for clothes and underwear and which is virtually impossible to undo by hand, without the use of a cutting aid such as a knife or scissors. Other types of thread or cord may be used. The hanger may therefore be used and connected to an item of clothing during the manufacturing process, during shipping as well as during sorting and retail as a "covering note" and/or as label. If the nylon thread 26 is long enough it would also makes fitting of the goods (eg trying on the goods for size or appearance) possible without any problems as a free-hanging label. For two-piece sets a fitting of the individual parts is only possible in succession. Therefore hanger 1 has large areas for printing and designing, this is especially very simple. So contrary to the prior hanger a multiple extended information area is available that furthermore refers exclusively to the fixed goods. Part of this area can be designed for the printing of product and trade information on it. A further sector, indicated in FIG. 7 by numeral 27, can bear security information, of the type that unless coding off or deactuation is performed when leaving the shop or similar, a control or security function (eg an alarm) is activated.

The printable area of the hanger can be divided into different regions in such a way that, for example, the front area is used for information transmission to the consumer and the back area is used for additional information or codes, for example with the left side for manufacturers or for marketing, the right side for trade or sale. This allows the element to form part of a logistic system which is controlled by an electronic data processing system, especially for the use of goods that are already labelled for sale when they are delivered.

The most important ecological advantages of the new hanger are based on the fact that previous types of manufactured hangers were for the most part manufactured in a spraying-cast process, which causes a lot of recycling problems. In this present case only one single material is used which is easy to dispose and to recycle. Furthermore, the simple and plausible handling does not allow a wrong operation. Breakage of the hanger is highly unlikely, lowering long-term costs. Multiple recycling of the foil saves costs and resources.

As described before, the hanger can be used as a label as well as a one-way or a long-term holding element. A combination of several work routines is possible. Data processing can be automated from the printing of the labels and the logistic control to the drawing up of invoices and sales receipts so that the flow of data and the security of goods will get improved.

Hanging elements according to the present invention may be printed upon, and/or pre-printed or writable information labels may be affixed (eg adhered) to them, and/or information may be formed upon them, and thereby form an integral part of them, at the time of manufacture.

In FIG. 1 the centre of hole 8 is shown as being offset from the axis of cut 7. Alternatively, the hole 8 may be formed centrally with its centre in line with the axis of cut 7, or otherwise. Further, or less strengthening elements and/or product holding slots may be provided.

What is claimed is:

1. A hanging element for clothing comprising:

a sheet of elastic shock-proof material for supporting clothing, having a top edge and a bottom edge and side edges, the horizontal width between the side edges being substantially greater than the vertical height between the top and bottom edges such as to provides dimensions for supporting clothing, a face of the sheet providing a portion upon which information can be presented;

a through-hole spaced from the top edge and being dimensioned for receiving a clothes rail upon which the hanger element can be supported;

a cut formed on the element and extending from the top edge of the element and through the sheet to the through-hole wherein in order to become engaged upon the rail, portions of the sheet adjacent the cut are displaced in generally opposite directions out of the plane of the sheet and around the rail until the rail is positioned in the through hole; and means for supporting clothing on said hanging element.

2. The hanging element of claim 1, further comprising strengthening portions formed by bulges having a circle segmental cross-section.

3. The hanging element of claim 2, wherein the cut and through-hole are at least partially surrounded by the strengthening portions.

4. The hanging element of claim 1, further comprising slots formed towards the upper edge for receiving parts of clothing to be hung and presented on the hanging element, each slot being connected to an edge of the hanging element by a cut.

5. The hanging element of claim 1, wherein both lateral edges of the hanging element are vertical.

6. The hanging element of claim 1, further comprising a security thread or cord connecting the hanging element to a piece of clothing.

7. The hanging element of claim 1, further including an area containing a security control installation.

8. The hanging element of claim 1, further including an area for a label.

9. The hanging element of claim 1, wherein the hanging element is rectangular.

10. The hanging element of claim 1, wherein labelling for viewing by a customer is located on one side, and information relevant to the manufacturer, distributor, wholesaler, retailer and/or security information is located on an opposite side.

11. The hanging element of claim 1, wherein the hanging element is formed by a vacuum-forming process.

12. A hanging element for clothing comprising:

a sheet of elastic shock-proof material for supporting clothing, having a top edge and a bottom edge and side edges, the horizontal width between the side edges being substantially greater than the vertical height between the top and bottom edges such as to provide dimensions for supporting clothing, a face of the sheet providing a portion upon which information can be presented;

a through-hole formed on the sheet and spaced from the top edge and being dimensioned for receiving a clothes rail upon which the hanger element can be supported;

a slot formed on the element extending from the top edge of the element to the through-hole, a slot and having a width which is substantially less than that of the through-hole, such that in order to become engaged upon the rail, portions of the sheet adjacent the slot are displaced in generally opposite directions out of the plane of the sheet and around the rail until the rail is positioned in the through hole; and reinforcing ribs disposed on said sheet along said top edge and extending around said slot and said through hole, but positioned so as not to interfere with the aforesaid movement of the sheet during engagement upon the rail.

13. A hanging element according to claim 12, wherein said slot extends perpendicularly from said top edge to one side of the through-hole.

14. A hanging element accord ing to claim 13, wherein said reinforcing ribs comprise:

a first rib length extending from one side edge along said top edge to said slot;

a second rib length extending from said slot to the opposite side edge;

a third rib length extending along side one edge of the slot from said top edge to the bottom of the through-hole;

a fourth rib length extend ing along the bottom of the through-hole; and a fifth rib length extending from the bottom of the through hole towards said top edge at the opposite side of the slot.

15. A hanging element according to claim 14 further comprising:

a sixth rib length extending from the top edge adjacent said slot to the top of the through-hole; and a seventh leg extending between the ends of the fifth and sixth edges, wherein said fifth rib length extends to a position above said through-hole.

16. A hanging element according to claim 13, wherein said slot is formed by a single cut on the sheet.

17. A hanging element according to claim 16, further comprising:

a second slot formed adjacent said top edge near a first end of said sheet;

a third slot formed adjacent said top edge near a second end of said sheet;

a cut on the sheet extending from the second slot to the top edge; and another cut on the sheet extending from the third slot to the top edge, wherein the cuts enable the placement of straps of a garment in said second and third slots.

18. A hanging element according to claim 17, further comprising reinforcing ribs extending around the edges of said second and third slots.

19. A hanging element according to claim 12, wherein the reinforcing ribs are each formed by a bulge in said sheet having a circular cross-section.

20. A hanging element for clothing comprising:

a sheet of elastic shock-proof material for supporting clothing, the sheet being generally rectangular in configuration and having a top edge and a bottom edge and side edges, the horizontal width between the side edges being substantially greater than the vertical height between the top and bottom edges such as to provide dimensions for supporting clothing, a face of the sheet providing a portion upon which information can be presented;

first and second slots disposed adjacent said top edge and adjacent said side edges for receiving garment straps, and cuts extending from said top edge to said slots to permit insertion of garment straps into said slots;

a through-hole spaced a significant distance from the top edge and being dimensioned for receiving a clothes rail upon which the hanger element can be supported; and a third slot formed on the element extending from the top edge of the element to the through-hole, the third slot having a width which is substantially less than that of the through-hole, such that, in order to become engaged upon the rail, portions of the sheet adjacent the third slot are displaced in generally opposite directions out of the plane of the sheet and around the rail until the rail is positioned in the through hole.

21. A hanging element according to claim 20, wherein said third slot extends perpendicular to said top edge to one side of the through-hole.

22. A hanging element according to claim 20, wherein said third slot is formed by a single cut on the sheet.

23. A hanging element according to claim 20, comprising reinforcing ribs disposed on said sheet along said top edge and extending around said third slot and said through hole, but positioned so as not to interfere with the aforesaid movement of the sheet during engagement upon the rail.

24. A hanging element according to claim 23, wherein said reinforcing ribs comprise:

a first rib length extending from one side edge along said top edge to said third slot;

a second rib length extending from said third slot to the opposite side edge;

a third rib length extending alongside one edge of the third slot from said top edge to the bottom of a through-hole;

a fourth rib length extending along the bottom of the through-hole; and a fifth rib length extending from the bottom of the through hole towards said top edge at the opposite side of the third slot.

25. A hanging element according to claim 24, further comprising:

a sixth rib length extending from the top edge adjacent said third slot to the top of the through-hole; and a seventh leg extending between the ends of the fifth and sixth edges, wherein said fifth rib length extends to a position above said through-hole.

26. A hanging element according to claim 20, further comprising reinforcing ribs extending around the edges of said first, second and third slots.

27. A hanging element according to claim 20, wherein the reinforcing rib is formed by a bulge in aid sheet having a circular cross-section.

28. A hanging element for clothing comprising:

a sheet of elastic shock-proof material for supporting clothing, the sheet having a top edge and a bottom edge and side edges, the horizontal width between the side edges being substantially greater than the vertical height between the top and bottom edges such as to provide dimensions for supporting clothing, a face of the sheet providing a portion upon which information can be presented;

first and second slots disposed adjacent said top edge and adjacent said side edges for receiving garment straps, and cuts extending from said top edge to said slots to permit insertion of garment straps into said slots;

a through-hole spaced distance from the top edge and being dimensioned for receiving a clothes rail upon which the hanger element can be supported;

a cut formed on the element and extending from the top edge of the element and through the sheet to the through-hole for permitting mounting of the hanger element upon the clothes rail with the clothes rail disposed in said through hole; and reinforcing ribs disposed on said sheet along said top edge and extending around said cut and said through hole, and including reinforcing ribs extending around the edges of said slots.

* * * * *